United States Patent [19]

Earle, III

[11] Patent Number: 4,827,679

[45] Date of Patent: May 9, 1989

[54] FLUID JET CUTTING SYSTEM WITH SELF ORIENTING CATCHER

[75] Inventor: George A. Earle, III, Dallas, Tex.

[73] Assignee: LTV Aerospace & Defense Company, Dallas, Tex.

[21] Appl. No.: 124,895

[22] Filed: Nov. 24, 1987

[51] Int. Cl.[4] ..... B24C 3/06

[52] U.S. Cl. ..... 51/410; 83/53; 83/177; 51/424; 51/321

[58] Field of Search ..... 51/410, 439, 424, 319–321, 51/283 R; 83/53, 177

[56] References Cited

U.S. PATENT DOCUMENTS 4,651,476 3/1987 Marx et al. ..... 51/410

FOREIGN PATENT DOCUMENTS 0140870 5/1985 European Pat. Off. ..... 83/177

2411069 8/1979 France ..... 83/177

*Primary Examiner*—Frederick R. Schmidt

*Assistant Examiner*—Robert A. Rose

*Attorney, Agent, or Firm*—J. M. Cate; S. S. Sadacca

[57] ABSTRACT

A system and process for fluid jet cutting of a workpiece providing for self orientation of a catcher vessel. This invention comprises a cutting head adapted to be connected to the robot arm of a robotically controlled cutting system. A nozzle is mounted in the cutting head and adapted to dispense a jet cutting fluid stream along a cutting axis to be directed against a workpiece. The system further comprises a catcher assembly including a bracket supporting a catcher vessel having a receiving aperture. The catcher vessel contains a sacrificial material for dissipation of kinetic energy of the spent jet cutting stream. The supporting bracket includes an arm which depends from the cutting head along a traverse which is laterally offset from the cutting axis. The catcher vessel is oriented so that the receiving aperture is aligned with the cutting axis of the nozzle so that the spent cutting stream emanating from the nozzle and passing through the workpiece ultimately passes into the aperture of the cutting vessel. The catcher assembly is rotatably mounted on the cutting head for rotation about an axis coincident with the cutting axis along which the fluid stream is directed. This allows the bracket and the catcher vessel to rotate relative to the nozzle while retaining the aligned orientation of the catcher vessel aperture with the cutting axis. Thus, the catcher vessel is maintained in a mechanically self oriented configuration relative to the nozzle throughout the cutting operation.

11 Claims, 3 Drawing Sheets

FIG. 4
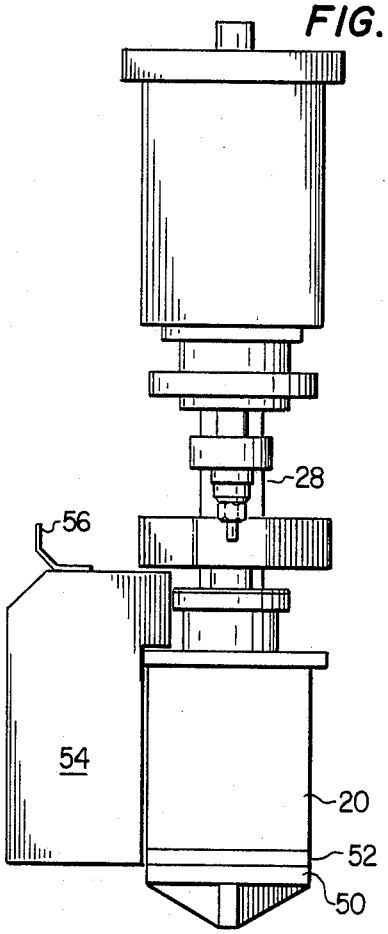
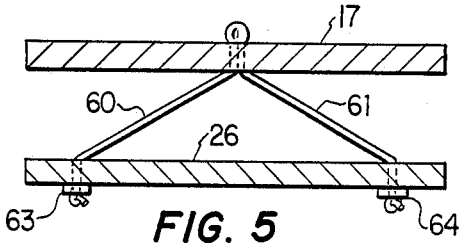
FIG. 5
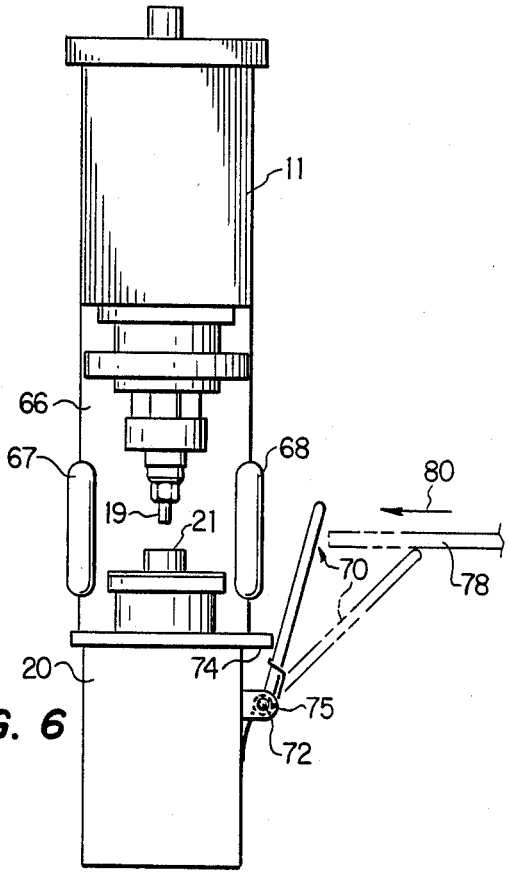
FIG. 6

FLUID JET CUTTING SYSTEM WITH SELF ORIENTING CATCHER

TECHNICAL FIELD

This invention relates to fluid jet abrasive cutting and more particularly to a computer controlled fluid jet abrasive cutting system employing a self orienting catcher vessel.

ART BACKGROUND

One technique for cutting workpieces such as metal panels and high performance composite panels used as air frame components involves the use of fluid abrasive cutting systems. These systems employ an injector nozzle which dispenses a liquid, such as water, entraining an abrasive material at extremely high pressures. The operating pressures of such systems normally range from 30,000 to 60,000 psi or higher. In a typical application, the high pressure liquid flowing through the nozzle induces a vacuum in a supply line leading to a source of an abrasive grit such as garnet, silica, alumina or the like. Typical abrasive constituents include 100 mesh abrasive particles for cutting composite materials such as composite laminates of graphite-epoxy or Kevlar Fiber reinforced resins and 60–80 mesh abrasive particles for cutting metals such as titanium and aluminum.

The high pressure jet stream passing through the cut or "kerf" formed in the workpiece normally retains a substantial kinetic energy necessitating that the stream be caught in a catcher vessel in a manner to dissipate the remaining energy. Various systems have been proposed for the control of the high pressure nozzle and an associated catcher vessel as the cutting head moves relative to the workpiece being cut. One relatively simple arrangement employed an articulated beam and swivel arrangement for movement of the cutting head through x, y and z axes is disclosed in U.S. Pat. No. 4,435,902 to Mercer, et al. In Mercer, a high pressure jet nozzle and a catcher vessel are interconnected by a U-shaped tube which extends around the side of the workpiece being cut. The catcher is equipped with an impingement disk to absorb the kinetic energy of the jet stream passing through the workpiece and into a catcher tube in the catcher body. The catcher tube can be moved up and down relative to the catcher body to provide a desired distance between the cutting nozzle and the catcher orifice to accommodate workpieces of different thicknesses. The catcher or the nozzle can optionally be equipped with pins to follow a track or guide which may be attached to the workpiece or work surface.

An alternative arrangement for absorbing the kinetic energy from a high pressure jet cutting stream is disclosed in U.S. Pat. No. 4,532,949 to Frank. In the Frank device, the energy absorber is in the form of a fluid flow conduit mounted in an adjustable support assembly which in turn is secured to the cutting head assembly in which the nozzle is mounted. In the Frank system, a carbide ball is mounted in a ball seat below the catcher orifice so that it is impinged by the jet stream entering the catcher chamber.

A substantially more sophisticated system for robotically controlled abrasive jet cutting is disclosed in Earle, III, George A., "Automatic Trimming of Composite Panels", SAE Paper No. 861,675, October 1986, Society of Automotive Engineers. As disclosed there, the robotic cutting system involves a cutting head which is moved relative to a workpiece by operation of a sixaxes gantry robot system. The workpiece to be cut is placed on a suitable support surface and the location of the workpiece relative to the gantry system is accurately determined by a visual control system which senses targets in the workpiece and makes appropriate changes in the program matrix to accommodate the actual position of the workpiece. The cutting head can be moved under the control of a central controller through a three axes cartesian coordinate system to arrive at the desired location. Movement through pitch and yaw axes can then be employed to arrive at the desired orientation of the cutting nozzle relative to the workpiece surface to be cut. A catcher vessel is supported from the cutting head a fixed distance from the nozzle by means of a bracket assembly which extends around the edge of the workpiece being cut. The catcher vessel is filled with stainless steel balls which act through erosion and mobilization of the balls to dissipate the kinetic energy of the spent cutting stream. The cutting head can be moved around a sixth axis coincident with the cutting axis of the nozzle in order to avoid impacting the bracket assembly upon the workpiece.

DESCRIPTION OF THE INVENTION

In accordance with the present invention, there is provided a new and advantageous system for the abrasive jet cutting of a workpiece and the dissipation of kinetic energy in the spent cutting stream by means of a self orienting catcher vessel. The invention comprises a cutting head adapted to be connected to the robot arm of a robotically controlled cutting system. A nozzle is mounted in the cutting head and adapted to dispense a jet cutting fluid stream along a cutting axis to be directed against a workpiece. The system further comprises a catcher assembly including a catcher vessel having a receiving aperture and a supporting bracket for the vessel. The catcher vessel contains sacrificial material for dissipation of kinetic energy of the spent jet cutting stream. The supporting bracket includes an arm which depends from the cutting head along a traverse which is laterally offset from the cutting axis. The bracket assembly supports the catcher vessel at a location spaced from the nozzle. The catcher vessel is oriented so that the receiving aperture is aligned with the cutting axis of the nozzle. Thus, the spent cutting stream emanating for the nozzle and passing through the workpiece ultimately passes into the aperture of the cutting vessel. The catcher assembly is rotatably mounted on the cutting head for rotation about an axis coincident with the cutting axis along which the fluid stream is directed. The rotatable mounting of the catcher assembly on the cutting head allows the bracket and the catcher vessel to rotate relative to the nozzle while retaining the aligned orientation of the catcher vessel aperture with the cutting axis. Thus, the catcher vessel is maintained in a mechanically self oriented configuration relative to the nozzle throughout the cutting operation. In a further embodiment of the invention, the catcher vessel is rotatably mounted on the bracket assembly in a manner in which it is free to rotate about the cutting axis of the nozzle. This enables the catcher vessel to retain a fixed angular orientation relative to the cutting head even though the bracket itself changes its angular orientation relative to the cutting head. This facilitates mounting of sensing means such as a remote vision camera on the catcher vessel.

In yet a further embodiment of the invention, an orientation member is mounted on the catcher assembly at a lower location and extends upwardly from the mounting location into the interval between the nozzle and the aperture. The orientation member is offset from the bracket arm in the direction of the cutting axis. The orientation member is mounted in a complaint relationship relative to the catcher assembly, so that upon contact with the edge of the workpiece being cut, the orientation member is ultimately forced downwardly to ride on the underside of the workpiece.

Yet a further aspect of the invention provides a process for providing initial proper orientation of the catcher assembly relative to the workpiece. In this procedure the cutting head is moved along a path toward the edge of the workpiece being cut. The cutting head is tilted to incline the cutting axis of the cutting head from the vertical in a direction away from the workpiece causing the bracket to swing in a direction outwardly away from the workpiece. Thereafter the cutting head is tilted through the reverse angle to reposition the head back to a cutting position in which the nozzle is pointed downwardly relative to the surface of the workpiece.

BRIEF DRAWINGS

FIG. 4 is a side elevation of a further embodiment of the invention employing guide means for maintaining the catcher vessel at a desired angular orientation during a cutting operation;

FIG. 5 is a sectional view along line 5—5 of FIG. 2 illustrating means for compliantly holding the catcher assembly at a desired position relative to the cutting head;

FIG. 6 is a side elevational of a further embodiment of the invention illustrating means for orienting the catcher assembly as the cutting head approaches a workpiece;

Figure 8A:
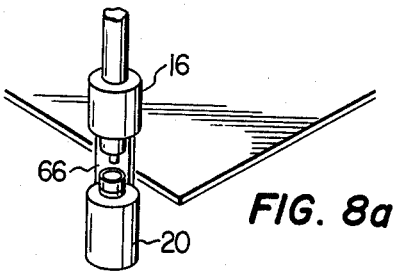
Figure 8B:
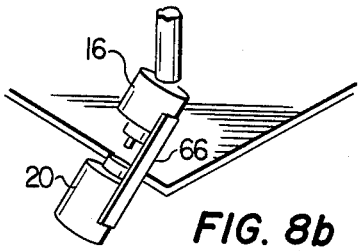
Figure 8C:
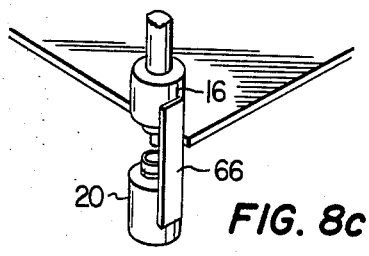

FIGS. 7(*a*)–7(*d*) are schematic illustrations showing sequential stages of operation of the embodiment of FIG. 6; and FIGS. 8(*a*)–8(*c*) are schematic illustrations showing sequential stages in a procedure for initiating a cutting operation to provide for initial orientation of the catcher assembly.

DETAILED DESCRIPTION OF THE INVENTION

The present invention is especially useful in vertical or near vertical cutting operations involving the edges of horizontal surfaces such as in the trimming of air frame panels and will be described in detail with respect to this application. Air frame panels such as those made of composite materials are typically formed on machined template surfaces to approximately the desired shape. After the composite structure is laid up and cured it is often desirable to cut the edges of the panel to the desired configurations. In the cutting operation it is usually necessary that the surfaces be cut very precisely, for example, to a tolerance of no more than ±0.03 inch.

Figure 1:
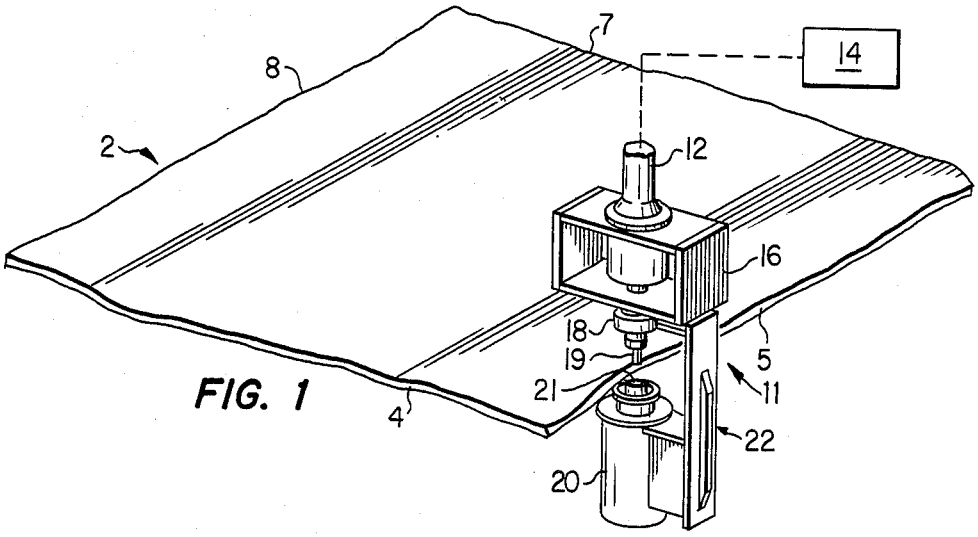
FIG. 1 is a schematic illustration showing a perspective view of the invention as employed in trimming the edge of an air frame panel.

Turning now to FIG. 1, there is illustrated a robotic abrasive water jet cutter incorporating the present invention which is employed to trim the edges of a panel 2 for use as an air frame member. As shown in FIG. 1, the forward edge 4 of the panel has been trimmed. The cutter is in the process of trimming compound edge 5, 6 and edges 7 and 8 have yet to be trimmed. The robotic cutting system comprises a head assembly 11 which is secured to a gantry support system (not shown) by robot arm 12. The system is under control of a central controller 14. Controller 14, which normally will be in the form of a dedicated microprocessor, operates to position the head assembly at a desired location in proximity to the workpiece by manipulation along the x, y and z axes of an orthogonal axis system. The head assembly is rotated relative to the robot arm under the direction of the controller using pitch and yaw axes to orient the cutter nozzle at the desired orientation. In the layout shown in FIG. 1, as the cutting head moves across the panel, it will be tilted from the vertical as necessary, to keep the nozzle normal to the tangent of the curved panel surface at the point of cutting. The head assembly is provided with high pressure plumbing hoses and abrasive and particulate supply hoses (none of which is shown), for the supply of particulates and water to form the high pressure abrasive containing jet stream. For a further description of a suitable robotic jet cutting system and its control, reference is made to the aforementioned SAE Paper No. 861,625 by Earle, the entire contents of which are incorporated herein by reference. A suitable material transfer system for the supply of fine abrasive particulates to the head assembly is described in U.S. patent application Ser. No. 901,482, filed Aug. 28, 1986, by Earle and Davis, the entire disclosure of which is incorporated herein by reference.

The cutting head assembly illustrated in FIG. 1 comprises a head frame 16 secured to the robot arm 12 and adapted to be moved through the pitch and yaw axes relative to the arm as described above, a nozzle assembly 18 including a jetting nozzle 19, and a catcher assembly comprising a vessel 20 mounted on a bracket 22. The catcher vessel 20 preferably is of the type described in the aforementioned article by Earle. The vessel has a receiving aperture 21 aligned with the jetting nozzle 19. As the jet stream passes through the kerf made in the workpiece it enters the receiver vessel through the receiving aperture. The kinetic energy of the stream is dissipated by contact with sacrificial elements such as stainless steel balls contained within the catcher. The catcher vessel is provided with hoses (not shown) for the withdrawal of water and particulates from abraded sacrificial elements and for the introduction of new elements.

The edge trimming of a complex contoured workpiece such as panel 2 shown in FIG. 1 requires orientation to the desired ordinates of the orthogonal axis system along the path to be cut and rotation about the pitch and yaw axes to orient the cutting nozzle to the desired orientation relative to the panel surface. The catcher vessel orifice 21 is maintained in a fixed orientation relative to the nozzle 19 by bracket 22 so that it is always in a position to receive the spent jet stream as it passes through the kerf made in the panel. It is also necessary to position the catcher vessel 20 around the sixth axis coincident with the cutting axis of the nozzle in order to maintain the bracket in a configuration in which it will not collide with the workpiece in a manner to damage either the workpiece or the cutting head assembly. This can be accomplished by programming the central controller to change the angular orientation of the catcher bracket around the sixth axis at various junctures along the cutting path. For example, as the cutting head assembly approaches a right angle change in direction along edge 5 to trim the offset portion 6, the processor could be programmed to swing the catcher bracket assembly clockwise through an angular segment sufficient to avoid collision of the bracket with the offset edge 6. In the present invention, such angular displacement of the bracket assembly can be effected by a simple mechanical expedient without the need for complex programming of the central control unit for movement of the catcher bracket about the sixth axis.

The foregoing self orienting feature of the present invention is accomplished by rotatably mounting the bracket assembly on the cutting head such that the bracket assembly rotates about the sixth axis which is coincident with the cutting axis of the nozzle. This arrangement enables the correct catcher vessel and bracket assembly to be maintained at all times without the need for a sensor and feedback control system. Also, it eliminates the need for programming of the microprocessor to provide for movement of the head assembly angularly around a sixth axis (coincident with the jet stream) in addition to the positioning movements along the x, y, and z axes of the Cartesian coordinate positioning system as well as the yaw and pitch axes to orient the direction of the jet stream relative to the cutting surface.

Figure 2:
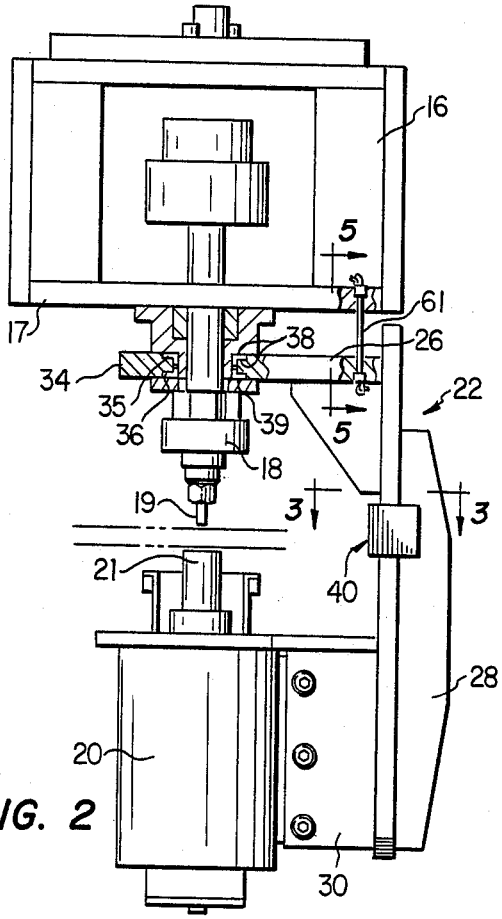
FIG. 2 is a side elevation with parts in section of the cutting head assembly shown in FIG. 1 illustrating the relationship between the nozzle and the catcher vessel while in use in cutting an air frame panel.

The foregoing relationships are illustrated in detail in FIG. 2 which is a side elevational view, with parts broken away, of the head assembly including the nozzle assembly and catcher assembly of FIG. 1. More particularly, as shown in FIG. 2 the head assembly comprises box frame 16 which is adapted to be connected to the robot arm 12. The box frame supports the nozzle assembly 18 and the catcher assembly including bracket 22 and catcher vessel 20. The bracket supports the catcher vessel in an orientation relative to the nozzle assembly so that the nozzle 19 and the catcher vessel aperture 21 at the upper end of collecting tube 24 are aligned. Thus, after the spent abrasive jet stream passes through the cut in the panel (shown in phantom in FIG. 2), it enters the catcher vessel where the action of the sacrificial elements (not shown) is to dissipate the remaining kinetic energy in the stream.

The bracket 22 comprises an upper support plate 26, a downwardly depending arm 28 offset sufficiently to clear the edge of the panel to be trimmed and a bottom bracket flange 30 to which the catcher vessel is secured. The upper support plate 26 is mounted for rotation relative to the box frame by means of a thrust bearing 34 which is capable of being loaded in either compression or tension. Thrust bearing 34 may be of any suitable type but in the embodiment illustrated comprises bearing segments 35 and 36 which are keyed to the bracket plate 26 and rotate on upper and lower bearing race surfaces 38 and 39, respectively. Alternatively, the thrust bearing may take the form of roller bearings held in place between the upper and lower bearing race surfaces by means of a retaining ring. The thrust bearing 34 in any case mounts the bracket assembly so that it is freely rotatable about the sixth robot axis which, as described above, is coincident with the cutting axis of the nozzle.

Figure 3:
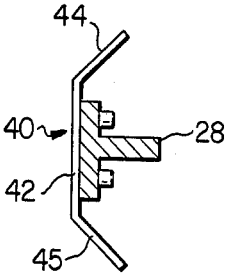
FIG. 3 is a plan view partly in sectional view taken along line 3—3 of FIG. 2.
Figure 7A:
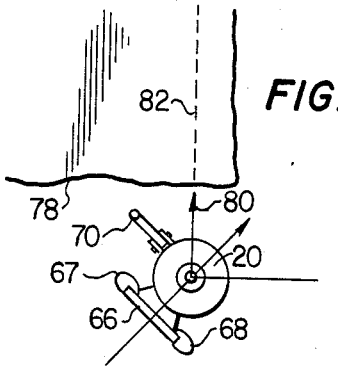
Figure 7B:
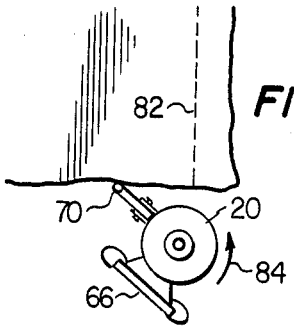
Figure 7C:
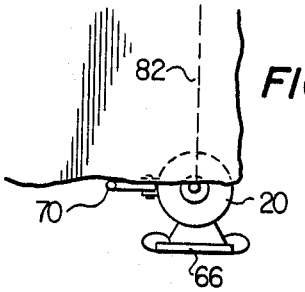
Figure 7D:
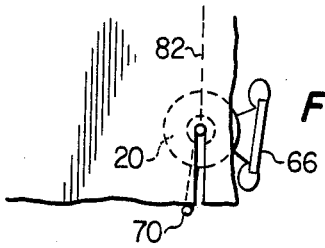

The bracket arm 28 supports a steering member 4 which is offset from the cutting axis at a location corresponding to the interval between the nozzle tip and the catcher vessel orifice so that it will contact the edge of the panel member 2, thus preventing the bracket arm itself from swinging into contact with the panel member. Steering member 40 may be of any suitable configuration but as shown in FIG. 3, it preferably provides surfaces which are at an inclined angle. This arrangement facilitates angular movement of the bracket as the steering member contacts the edge of the panel member. Thus, as shown in FIG. 3, the steering member 40 comprises a front surface 42 which is generally aligned in the direction of travel of the cutting head and inclined side members 44 and 45 which are inclined with respect to the direction of travel. Alternatively, instead of a segmented angular member as shown in FIG. 3, the steering member can take a form of an arcuate segment extending through an angle of perhaps 90 degrees.

Turning now to FIG. 4, there is illustrated a modified form of the invention which is especially useful where sensors such as a vision systems are used to monitor operation of the robotically controlled cutting operation. In this embodiment of the invention, the catcher vessel 20 is rotatably mounted on the bracket assembly for rotation about the cutting axis. More specifically, and as shown in FIG. 4, the bracket assembly comprises a bottom support plate 50 extending inwardly from bracket arm 28. The catcher vessel 20 is mounted on the support plate 50 by means of a thrust bearing 52 which may be of any suitable configuration, similarly as described above with respect to bearing 34. A vision system 54, for example, a system incorporating a video camera (not shown) is mounted on the catcher vessel 20. In order to maintain the camera lens at a fixed orientation as the bracket assembly undergoes changes in angular orientation relative to the cutting head, the system 54 is provided with the guide pin 56 which is designed to ride in the kerf left by the jet cutting stream. This assures retaining a proper alignment of the camera to constantly monitor the cutting operation. As an alternative to pin 56, the guide means can take the form of an element to ride on a support tool or any other appropriate member which would retain the catcher vessel and camera mounted thereon in the proper alignment.

The invention has been described thus far with respect to a robotic cutting system which is not programmed for orientation of the catcher assembly about the sixth axis. However the invention may also be employed in a system having sixth axis programming to provide a backup or fail safe function in the event of a program error or implementation failure. In this embodiment of the invention the catcher assembly, while rotatively mounted on the cutting head as described above, is also provided with means for compliantly holding the catcher assembly in a desired angular position relative to the cutting head. The sixth axis programming is then employed to position the catcher assembly so that the bracket arm 28 does not interfere with the edge of a workpiece being cut. If the bracket arm is misoriented, notwithstanding this programming option, sufficient compliance in the holding mechanism is provided to permit the catcher assembly to rotate as before. This embodiment of the invention is illustrated in FIG. 2 and in FIG. 5 which is a sectional view taken along line 5—5 of FIG. 2. As shown in FIGS. 2 and 5, the compliant holding means can be provided simply and expediently by means of elastic members 60 and 61 secured to the bottom plate 17 of head frame 16 and secured to the upper support plate 26 of the bracket assembly at spaced apart positions 63 and 64. The elastic members 60 and 61 will hold the catcher assembly in a fixed orientation relative to the head frame and the sixth axis programming can be employed to position arm 28 on the outward side of the workpiece being trimmed. Should an error occur, members 60 and 61 are sufficiently elastic to permit rotation of the catcher assembly to an orientation in which the bracket arm rides on the outside edge of the workpiece being cut. Members 60 and 61 and may conveniently take the form of surgical tubing secured in holes shown by broken lines in plates 17 and 26. Alternatively, highly resilient tension springs can be used.

In a further embodiment of the invention there is provided a catcher assembly rotatably mounted relative to the cutting head as described above which further comprises an orientation member which functions to properly position the catcher assembly as the cutting head is directed toward a workpiece to be cut. The orientation member is compliantly mounted on the catcher assembly and in its normal upper position extends into the vertical interval defined by the tip of the nozzle and the receiving vessel aperture. When the orientation member as thus positioned contacts the edge of a workpiece to be cut, it functions to swing the catcher assembly into an outward position at which the bracket arm is positioned outwardly of the edge of the workpiece. The orientation member is sufficiently compliant such that as the cutting head travels across the workpiece, it is forced downwardly and rides on the underside of the workpiece. The embodiment of the invention employing an orientation member as described above as illustrated in FIGS. 6 and 7.

As shown in FIG. 6, a catcher assembly comprising a catcher vessel 20 is rotatably mounted on cutting head 11 similarly as in the embodiments of the invention described above with respect to FIGS. 1–3. The catcher functions similarly as described previously except in this case the downwardly pending bracket arm 66 is provided with bumpers 67 and 68 at its edges to accommodate contact with the edge of a workpiece being cut. Bumpers 67 and 68 may be formed of a material such as teflon or the like. The catcher assembly is further provided with a orientation member 70 which in the embodiment shown comprises a finger pivotally mounted on the side of the catcher vessel by means of a pin connection 72 which is compliantly held in an upward position against a stop member 74 by means of a torsion spring 75 mounted on pin connection 72. Arm 76 of spring 75 biases finger 70 upwardly. Alternatively, the finger 70 can be biased upwardly against stop member 74 by means of a tension spring (not shown) connected between finger 70 and vessel 20 at a location above the pin connection. As illustrated in FIG. 6, with the member 70 in the position shown abutting against stop member 74, the upper portion of the member extends into the interval between nozzle 19 and aperture 21 which is occupied by the workpiece during the cutting operation. After the cutting operation is initiated, the orientation member 70 is deflected downwardly to the position as shown in broken lines so that it rides on the underside of the workpiece 78 being cut, indicated in phantom. The direction of travel at this point is indicated by arrow 80.

The operation of the orientation member to properly position the catcher assembly is indicated by the sequential stages of FIG. 7. In FIG. 7, the arm 66 of the catcher bracket, the catcher vessel 20 and member 70 are illustrated schematically in plan view. In FIG. 7(*a*) the cutter head is operated by the robot arm (not shown) to approach the workpiece 78 to be cut along a direction of travel indicated by arrow 80 to provide a desired cutting path indicated by broken line 82. As also shown, the orientation of the bracket arm is such that it is aligned to contact the leading edge of the workpiece 78. As illustrated in FIG. 7(*b*), contact is made between the leading edge of the workpiece and the orientation member 70 causing the assembly to start rotation in a counterclockwise direction as indicated by arrow 84. FIG. 7(*c*) shows the point at which the cutting action begins to cut a curve along the path indicated by broken line 82. Upon continued advancement of the cutting head along the desired cutting path, further counterclockwise rotation of the catcher assembly occurs until the orientation indicated in FIG. 7(*d*) results. As illustrated there, the assembly has rotated to the proper orientation where the bracket arm 66 is outside the lateral edge of the workpiece being cut. Upon continued advancement of the cutting head along the desired cutting path, the orientation member 70 will be biased downwardly against the action of the torsion spring to where it rides in the position indicated in phantom in FIG. 6.

In the embodiment illustrated in FIGS. 6 and 7, the orientation member can be mounted on the side of the catcher vessel in order to provide its appropriate location in the catcher assembly where it is laterally offset from the bracket arm in the direction of the cutting axis. Preferably, the orientation member extends outwardly and upwardly in a plane extending generally parallel to the bracket arm and radially of the cutting axis. This arrangement accommodates an angular positioning error of the bracket assembly of at least 120°. However, the orientation member can be mounted either in front of or behind the position illustrated in FIG. 7. Also while the orientation member is conveniently mounted on the catcher vessel in the embodiment in which the catcher vessel is not rotatably mounted in the bracket assembly, and thus the member is in a fixed orientation relative to bracket arm 66, where the catcher vessel is rotatably mounted in the catcher assembly, as in the embodiment of FIG. 4, other mounting implementation should be employed. For example, the orientation member can be pivotally mounted on a flange extending forward from the bracket arm or on the bottom mounting plate 50 (FIG. 4) so the orientation member and the downwardly depending bracket arm are retained in a fixed relationship. In either arrangement, the orientation member in its normal position extends upwardly and outwardly as shown in FIG. 6 with a stop member being provided to ensure that the orientation member is deflected somewhat from the vertical to facilitate its being moved downwardly and sliding on the underside of the workpiece, once it completes its function.

In order to ensure that the bracket assembly is in an orientation relative to the cutting head so that it can be readily moved to the correct position by the passive orientation system of FIGS. 6 and 7, a simple manipulation can be performed as the cutting head approaches the workpiece to be cut. This manipulation is made possible by the fact that the cutting head is connected to the robot arm end through a wrist connection permitting rotation of the head assembly relative to the robot arm through the fourth and fifth robot axes pitch (or and aft) that is, the roll (from side to side) and axes. In this aspect of the invention, the robot is commanded to approach the workpiece along the path of the edge to be trimmed. Before reaching the workpiece, for example about 18 inches away from the leading edge, the wrist connection of the robot arm end is manipulated to incline the cutting axis from the vertical in a direction away from the edge of the workpiece so that the cutting axis is at a substantial deviation from the vertical. In practice, the cutting head typically will be manipulated through an angle in a plane generally normal to the direction of travel of the cutting head by manipulation along the roll axis. However, manipulation through the pitch axis may also be employed so long as the cutting axis of the cutting head is tilted away (backward relative to the direction of travel) from the proximate edge of the workpiece. Once in the tilted attitude (which may, if necessary, place the cutting axis in a horizontal or near horizontal position), the catcher assembly will tend to fall under the influence of gravity to the underside of the cutting head axis. With the catcher assembly now in a generally known orientation, the cutting head is rotated along the reverse angle back to the cutting position and the bracket arm will be located generally toward the scrap side of the workpiece, ensuring proper operation of the passive orientation mechanism.

This operation of the invention is illustrated schematically in FIG. 8. As shown in FIG. 8(*a*), the cutting head is approaching the workpiece in an orientation in which the bracket arm 66 is disposed such that it will contact the leading edge of the workpiece. The workpiece is to be cut along a counterclockwise path, and thus in order to locate the bracket on the scrap side of the workpiece, the cutting head assembly is tilted along the roll axis by clockwise rotation as viewed from behind toward the direction of travel. As shown in FIG. 8(*b*), the axis of the cutting head has been tilted away from the edge of the workpiece by a substantial angle deviating from the vertical, e.g., usually at least 30° from the vertical, thereby causing the bracket to swing out and downwardly into the influence of gravity. Thereafter, the cutting head is rotated through the reverse angle to the cutting position shown in FIG. 8(*c*) so that as the cutting head is advanced to the workpiece, the bracket arm will either be outside on the scrap side of the workpiece or at least in the position where the orientation member can cause it to swing to the desired location. It will be recognized that were the cutting path to be reversed so that the cutting head travels in a clockwise direction, the tilting operation illustrated in FIG. 8(*b*) would likewise be reversed. That is, the cutting head would be tilted in a counterclockwise direction as viewed in the direction of travel. In this case the orientation member 78 would be on the opposite side of the catcher vessel from the position shown in FIG. 7.

Rotation of the cutting head through the pitch axis may also be employed to arrive at an initial orientation of the catcher assembly including the bracket arm to enable proper operation of the orientation member. Here, the cutting head must be rotated so that the upper segment of the cutting axis is inclined away from the workpiece along the direction of travel so that the bracket arm will fall under the influence of gravity to a position which is behind the axis relative to the direction of travel when the cutting head is returned to the vertical cutting position. That is, the bracket arm would be in an orientation as shown generally in FIGS. 7*a* through 7*c*. Operation of the orientation member can then be relied upon to swing the bracket arm outwardly where it is away from the scrap edge of the workpiece.

Having described specific embodiments of the present invention, it will be understood that modification thereof may be suggested to those skilled in the art, and it is intended to cover all such modifications as fall within the scope of the appended claims.

I claim:

1. In a system for the abrasive jet cutting of a workpiece and the dissipation of kinetic energy in an abrasive jet cutting stream, the combination comprising:

a cutting head adapted to be connected to a robot arm end for movement relative to a workpiece;

a nozzle mounted in said cutting head and oriented to dispense a jet cutting fluid stream from said nozzle along a cutting axis adapted to be directed against a workpiece;

a catcher assembly carried by said cutting head and including a catcher vessel having a receiving aperture and containing sacrificial material for dissipation of kinetic energy of said stream and a supporting bracket for said vessel, said bracket having an arm member depending downwardly from said cutting head in a laterally offset position from said cutting axis and supporting said catcher vessel at a location spaced from said nozzle in an orientation in which said receiving aperture is aligned with the cutting axis of said nozzle whereby a cutting stream emanating from said nozzle and passing through a workpiece will pass into the aperture of said catcher vessel; and means for rotatably mounting said catcher assembly on said cutting head for rotational movement of said bracket about said cutting axis whereby said catcher assembly may rotate relative to said nozzle while retaining the aligned orientation of said catcher vessel aperture with said cutting axis.

2. The combination of claim 1 further comprising a steering member mounted on said arm member and laterally offset from said cutting axis at a location corresponding to the interval between said nozzle and said aperture whereby said steering member upon contact with the edge of a workpiece being cut retains said bracket member in a location offset from an edge of the workpiece.

3. The combination of claim 1 wherein said catcher assembly further comprises an orientation member mounted on said catcher assembly at a location below the interval between said nozzle and said aperture and offset from said arm member in the direction of said cutting axis, said orientation member extending upwardly from said mounting location into the interval between said nozzle and said aperture in a compliant relationship relative to said catcher assembly to permit said orientation member upon contact with the edge of a workpiece being cut to be forced downwardly and ride on the underside of the workpiece being cut.

4. The combination of claim 1 further comprising means for rotatably mounting said catcher vessel on said bracket for rotation of said catcher vessel about the cutting axis of said nozzle.

5. The combination of claim 4 further comprising guide means secured to said catcher vessel to maintain said catcher vessel in a desired orientation relatve to said cutting head assembly.

6. The combination of claim 5 wherein said guide means comprise a guide pin extending upwardly relative to said catcher vessel and adapted to contact a surface of a workpiece being cut.

7. The system of claim 1 further comprising holding means for compliantly positioning said bracket assembly at a desired angular position relative to said cutting head, said holding means being sufficiently complaint to permit rotation of said bracket assembly relative to said cutting head upon contact of said bracket assembly with an edge of a workpiece being cut.

8. The system of claim 1 further comprising means interconnecting said cutting head and said robot arm end in a manner enabling the rotation of said cutting head through a plane generally normal to the projected angle of travel of said cutting head from an orientation of said cutting head in which the cutting axis is disposed vertically to an orientation in which said axis is inclined from the vertical permitting said bracket assembly to rotate under the influence of gravity to one side.

9. In a method for the abrasive jet cutting of a generally horizontally disposed workpiece, the steps comprising, providing a cutting head having a nozzle mounted therein and a catcher assembly comprising a catcher vessel having a receiving aperture and containing sacrificial material for the dissipation of kinetic energy remaining in a cutting stream and a bracket for holding said catcher vessel in an orientation in which the receiving aperture is aligned with the cutting axis of the nozzle, said catcher assembly being rotatably mounted on said cutting head for rotation about the cutting axis of said nozzle, moving said cutting head along a path toward the edge of said workpiece in a position to operate said cutting assembly to trim an edge of said workpiece, tilting said cutting head through an angle to incline said cutting axis from the vertical in a direction away from a proximate edge of said workpiece to cause said bracket to swing outwardly away from said workpiece, thereafter tilting said cutting head through a reverse angle back to a cutting position in which said nozzle is pointed downwardly toward the upper surface of said workpiece, and moving said cutting head along said workpiece while directing a high pressure stream of fluid containing abrasive particulate material from said nozzle to produce a cutting kerf in said panel and collecting spent cutting stream emanating from the bottom of the cutting kerf in said panel through the receiving aperture of said catcher vessel.

10. The method of claim 9 wherein said cutting head is tilted by rotation through the roll axis of said cutting head through an angle in a plane generally normal to the direction of travel of the cutting head toward said workpiece.

11. The method of claim 9 wherein said cutting head is tilted by rotation through the pitch axis of said cutting head through an angle in a plane generally along the direction of travel of said cutting head toward said workpiece so that said cutting head axis is inclined away from the leading edge of said workpiece.

* * * * *